US005943827A

United States Patent [19]

Okerlund

[11] Patent Number: 5,943,827

[45] **Date of Patent: *Aug. 31, 1999**

[54] RETAINING WALL BLOCK WITH LIGHT

[75] Inventor: Larry D. Okerlund, Alexandria, Minn.

[73] Assignee: Concrete Products of New London, Inc., Monticello, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/602,610

[22] Filed: Feb. 16, 1996

[51] Int. Cl.[6] ..... E04C 1/39

[52] U.S. Cl. ..... 52/28; 52/604; 52/606; 52/609; 362/147; 405/286

[58] Field of Search ..... 52/173.1, 173.3, 52/596, 606, 605, 607, 597, 599, 603, 102, 28, 604; 405/284, 285, 286; 362/145, 147, 152, 146, 151, 153, 153.1; 446/484, 485; 264/333, 336

[56] References Cited

U.S. PATENT DOCUMENTS

| | | | |
|---|---|---|---|
| D. 362,511 | 9/1995 | Anderson et al. . | |
| 1,992,785 | 2/1935 | Steuer | 52/605 |
| 4,223,377 | 9/1980 | Williams | 52/28 X |
| 4,524,551 | 6/1985 | Scheiwiller | 52/605 X |
| 5,003,746 | 4/1991 | Wilston . | |
| 5,017,049 | 5/1991 | Sievert . | |
| 5,062,610 | 11/1991 | Woolford et al. . | |
| 5,066,440 | 11/1991 | Kennedy et al. | 264/336 |
| 5,127,452 | 7/1992 | Wilston . | |
| 5,160,202 | 11/1992 | Legare | 362/145 X |
| 5,249,950 | 10/1993 | Woolford . | |
| 5,277,853 | 1/1994 | Allison et al. | 264/336 |
| 5,282,700 | 2/1994 | Rodrique | 405/284 |
| 5,294,216 | 3/1994 | Sievert . | |
| 5,425,600 | 6/1995 | Gordon . | |

FOREIGN PATENT DOCUMENTS

| | | | |
|---|---|---|---|
| 711622 | 6/1965 | Canada | 362/152 |

OTHER PUBLICATIONS

Central Landscape Supply, Inc., Catalog, dated prior to Feb. 16, 1996.

*Primary Examiner*—Michael Safavi
*Attorney, Agent, or Firm*—Nawrocki, Rooney & Sivertson, P.A.

[57] ABSTRACT

Block assembly for use in retaining wall systems. The block assembly includes a body having a front surface, a rear surface, a top surface, and a bottom surface. A formed recess is located within the block having a recess opening extending out the front surface, for accepting a light fixture assembly. A light fixture assembly may be positioned within the recess and coupled to a power source.

4 Claims, 5 Drawing Sheets

RETAINING WALL BLOCK WITH LIGHT

FIELD OF THE INVENTION

The present invention relates in general to landscaping systems. Particularly, the present invention relates to a retaining wall block having a light for use in landscape retaining wall systems.

BACKGROUND OF THE INVENTION

Retaining wall structures are commonly used as part of landscape designs. Retaining wall structures function to provide structural support for transitioning between various levels of grade. Retaining wall structures within landscape designs are also very aesthetically pleasing, functioning to define areas containing landscape shrubs and flowers.

Landscape lighting systems function to safely light walking paths or driveways, while providing light to landscape designs for visualization during night time hours. Landscape lighting systems typically include light fixture housings mounted on or within posts. The lighted posts are low to the ground, and located along driveways or walking paths, adjacent retaining walls, and other landscaped areas.

It is desirable to have a retaining wall structure having lights located within the retaining wall for lighting the retaining wall, adjacent landscaped areas, walkways, driveways, or other desired areas. It is also desirable to be able to easily manufacture retaining wall blocks which may be used in a standard retaining wall system, wherein the blocks include a light fixture coupled to a landscape lighting system.

SUMMARY OF THE INVENTION

The present invention relates to landscaping systems. Particularly, the present invention relates to a retaining wall block having a light for use in landscape retaining wall systems.

In one embodiment, the present invention is a block assembly for use in retaining wall systems. The block assembly includes a block body having a front surface, a rear surface, a top surface and a bottom surface. A formed recess is located within the block. The recess has an opening in the front surface, for accepting a light fixture assembly.

The recess opening may also be in the bottom surface. The recess opening may be located along the lower front edge, defined by the edge where the front surface and the bottom surface meet.

The block assembly may further include a channel extending between the recess and a surface of the block. In one preferred embodiment, the channel extends between the recess and the rear surface of the block. The channel may be open to the bottom surface.

A light fixture assembly is positioned within the recess. The shape of the recess corresponds with the shape of the light fixture. The light fixture may include a power cord for coupling the light fixture to a power source. Means are provided for allowing the power cord to exit the block body. In one embodiment, the means for allowing the power cord to exit the block body is a channel extending between the recess and the rear surface of the block. The light fixture assembly includes a housing having a removable lens. The light fixture housing is secured to the block.

Yet another embodiment of the present invention includes a method of manufacturing a block assembly. A block mold is provided. The mold is filled with a block mix. The block mix is compressed into the mold, including forming a recess in the block mix, to form a retaining wall block. The retaining wall block is removed from the block mold. The retaining wall block is then allowed to cure. Additionally, a channel may be formed in the block mix. A light fixture assembly may be positioned within the recess.

Another embodiment of the present invention includes a stripper shoe assembly used in compressing cement mix within a mold to form a retaining wall block. The stripper shoe assembly includes a generally flat plate. Means extend from the plate for forming a recess in the retaining wall block for accepting a light fixture. Additionally, means may extend from the stripper shoe assembly for forming a channel in the retaining wall block.

The retaining wall lighted block, formed in accordance with the present invention, provides a retaining wall system having lights for providing light to landscape designs for visualization during night time hours, and to safely light walking paths or driveways adjacent the retaining wall.

BRIEF DESCRIPTION OF THE DRAWINGS

Other objects of the present invention and many of the attendant advantages of the present invention will be readily appreciated as the same becomes better understood by reference to the following detailed description when considered in connection with the accompany drawings in which like reference numerals designate like parts throughout the figures thereof, and wherein.

DETAILED DESCRIPTION OF THE PREFERRED EMBODIMENT

Figure 1:
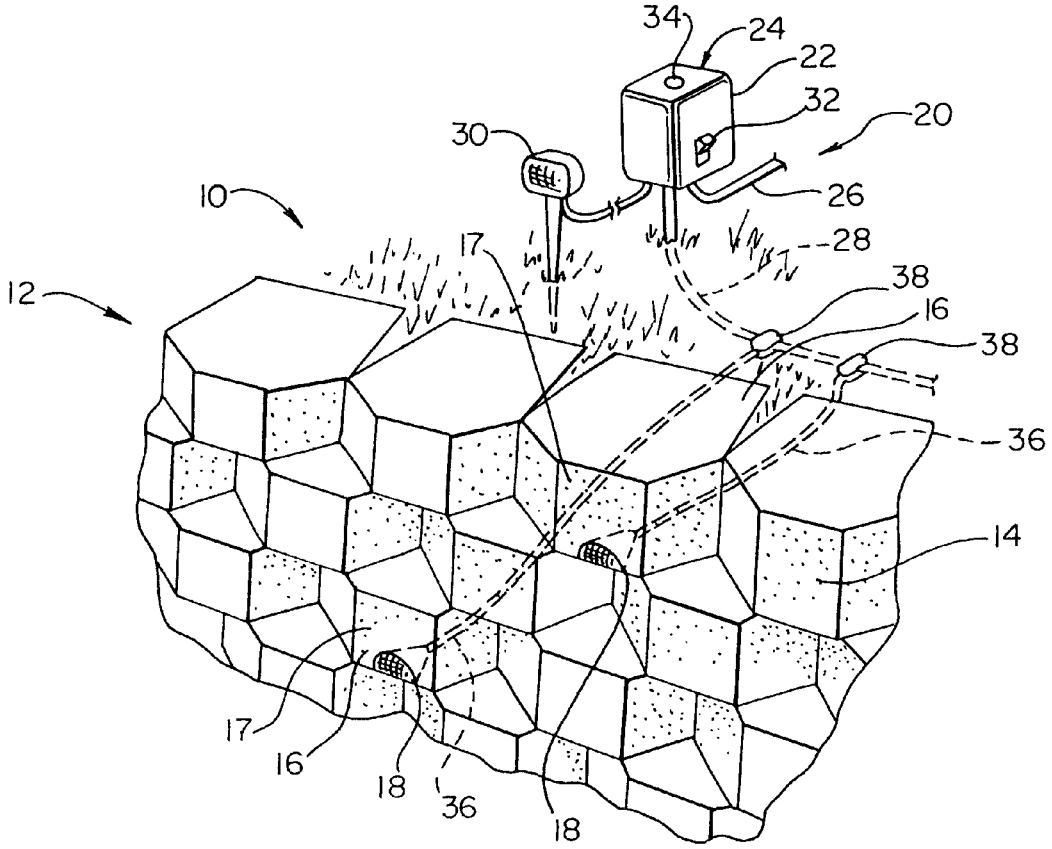
FIG. 1 is a partial perspective view showing one embodiment of a retaining wall system in accordance with the present invention.

FIG. 1 shows a retaining wall system in accordance with the present invention generally at 10. Retaining wall system 10 incorporates landscape lighting into a retaining wall for efficient and aesthetically pleasing lighting of adjacent landscape, walkways, driveways, landscape objects, or other areas.

The retaining wall system 10 includes retaining wall 12 formed of retaining wall blocks 14 and retaining wall block assemblies 16. Block assemblies 16 are interchangeable with blocks 14, and may be positioned at any location, and in various lighting designs, along retaining wall system 10.

Each block assembly 16 includes a light fixture 18, which is electrically coupled to landscape lighting system 20. In one embodiment, landscape lighting system 20 includes a low voltage transformer 24 (located within electrical power box 22) coupled to a power source, indicated at 26, such as a power pole or house panel board. Low voltage transformer 24 transforms the voltage from a relatively high voltage power source to a low voltage, such as 12 volts or AC (alternating current), for use in a landscape lighting system 20. It is also recognized that light fixture 18 may operate from other power sources, such as being solar powered.

Extending from low voltage transformer 24 is landscape electrical power feeder 28. Coupled to landscape electrical power feeder 28 at electrical power box 22 is photocell 30. Photocell 30 allows power to be switched on to the landscape lighting system automatically during night time hours, and switched off at daylight hours. Electrical power box 22 may also include a manual disconnect switch 32 for manually disconnecting power to the landscape electrical power feeder 28. Further, electrical power box 22 may include a timer system 34 coupled to the landscape electrical power feeder 28 at the electrical power box 22 for timed on/off intervals of the landscape lighting system 20.

Each light fixture 18 is coupled to the landscape electrical power feeder 28 through their respective light fixture power cord 36. In one embodiment, each light fixture power cord 36 is coupled to the landscape electrical power feeder 28 using a quick disconnect 38.

Figure 2:
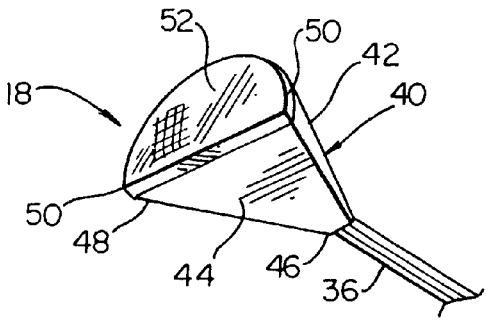
FIG. 2 is a perspective view showing one embodiment of the light fixture located within the retaining wall of FIG. 1.

Referring to FIG. 2, a perspective view of one embodiment of light fixture 18 is shown. Light fixture 18 includes a semi-cone shaped housing 40. Contained within housing 40 (not shown) is a lamp system coupled to power cord 36. Housing 40 includes a top surface 42 and a base 44. Light fixture power cord 36 exits the housing 40 at the rear 46. Extending from the housing front 48 is a flange 50.

Figure 3:
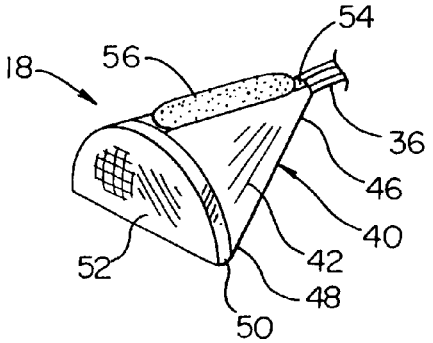
FIG. 3 is a top perspective view of the light fixture shown in FIG. 2.

Snap-fit over flange 50 is light fixture lens system 52. Lens system 52 may be further secured to housing 40 using screws. Lens system 52 allows protection for the lamp system contained within housing 40, while allowing light to pass through the lens system 52. The lens system 52 may be designed to disperse light from housing 40 in a desired direction. In one embodiment, lens system 52 directs light outward and downward from a retaining wall block having a recess for accepting/retaining a light 17 (hereinafter recessed block 17). Additionally, it is recognized that lens system 52 can allow light fixture 18 to be used for other purposes, such as a spotlight. Lens system 52 may be easily removed from housing 40 for changing out the light fixture 18 lamp. Referring to FIG. 3, a top perspective view of light fixture 18 is shown. Within top surface 42 of housing 40 is channel 54 (partially shown). Channel 54 holds adhesive sealant 56 for coupling light fixture 18 to recessed block 17.

Figure 4:
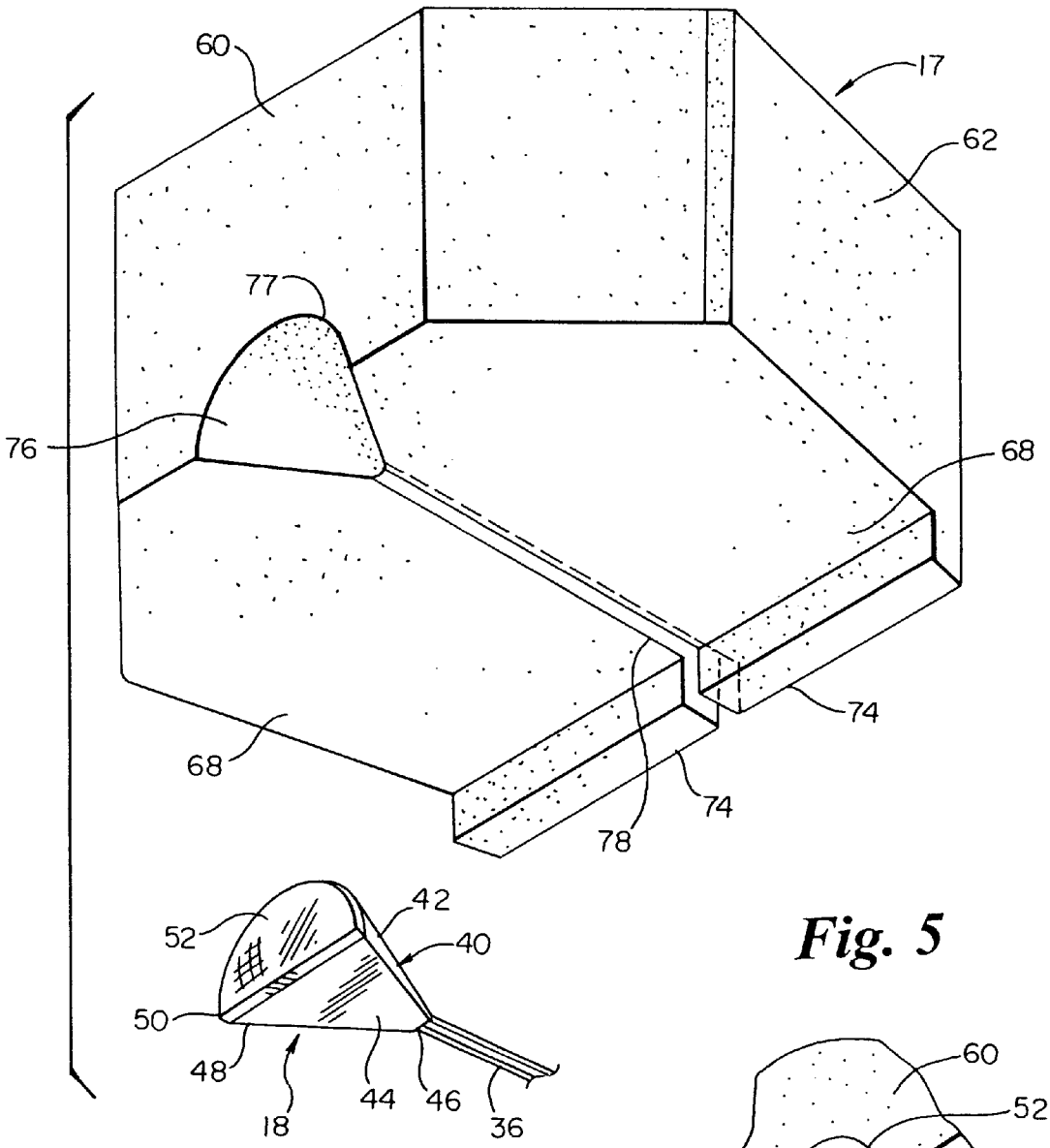
FIG. 4 is an exploded view of a retaining wall block assembly in accordance with the present invention.

Referring to FIG. 4, an exploded view of the retaining wall block assembly 16, including recessed block 17 and light fixture 18, is shown at 58. Retaining wall recessed block 17 includes a front surface (face) 60, a first side 62, a second side (not shown), a top surface (not shown), a bottom surface 68, and rear surface (not shown). Front surface 60 further may take on various designs, including angled portions (shown) or be generally substantially straight.

Extending downward from a rear edge of bottom surface 68 is anchor system 74. In a retaining wall system, each layer of retaining wall blocks is commonly set back from the layer below it. As the second course or layer of blocks is positioned over the first course or layer of blocks, the second course or layer of blocks is set over the first course, such that anchor system 74 extends along the rear surface of the first layer of blocks. The second layer of blocks is typically set back from the first layer of blocks by the thickness of the anchor system 74.

It is recognized that retaining wall recessed block 17 may take on various design shapes and forms while remaining within the scope of the present invention. For example, front face 60 may include angled side portions as shown, or may be substantially flat. In one preferred embodiment, the recessed block 17 ranges in size from 4 inches to 7 inches high and 12 inches to 18 inches wide. It is recognized that retaining wall recessed block 17 may be much larger or much smaller than the recited dimensions.

Located within retaining wall recessed block 17 is recessed area receptacle 76. Recessed area 76 is sized for receipt of light fixture 18. In one embodiment, recessed area 76 is located along a bottom edge of front surface 60, and opens into front surface 60 (indicated as lens opening 77) and bottom surface 68. The size of recessed area 76 corresponds to the size of light fixture 18. It is recognized that recessed area 76 may open along any edge of front surface 60 or within the center area of front face 60 (or take up the whole face 60).

Figure 5:
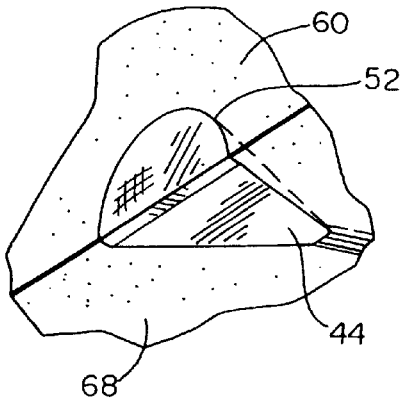
FIG. 5 is a partial perspective view of the retaining wall block assembly of FIG. 4 showing the light fixture positioned within the retaining wall block.

Recessed area 76 is sized for receipt of light fixture 18. Extending from recessed area 76 is means for allowing power cord 36 to exit recessed block 17. In one embodiment, extending between recessed area 76 and rear surface 66 along the bottom surface 68 is (power cord) channel 78. Referring to FIG. 5, light fixture 18 is shown positioned within recessed area 76. When located within recessed area 76, light fixture lens system 52 may be substantially flush with front surface 60 or recessed with respect to front surface 60, and the housing base 44 is substantially flush with the bottom surface 68 of the retaining wall recessed block 17. Light fixture power cord 36 conveniently exits the rear of housing 40 through channel 78, exiting the recessed block 17 at rear face 66.

The novel block assembly 16 of the present invention allows retaining wall structures to have lights located within the retaining wall for lighting the retaining wall, adjacent landscaped areas, walkways, driveways, or other desired areas. Landscape block assembly 16 is interchangeable with other retaining wall blocks, and may be connected to landscape lighting systems. Landscape block assembly 16 including formed or molded recessed block 17 are easily manufactured and mass produced, and do not require field modifications or high maintenance.

Figure 6:
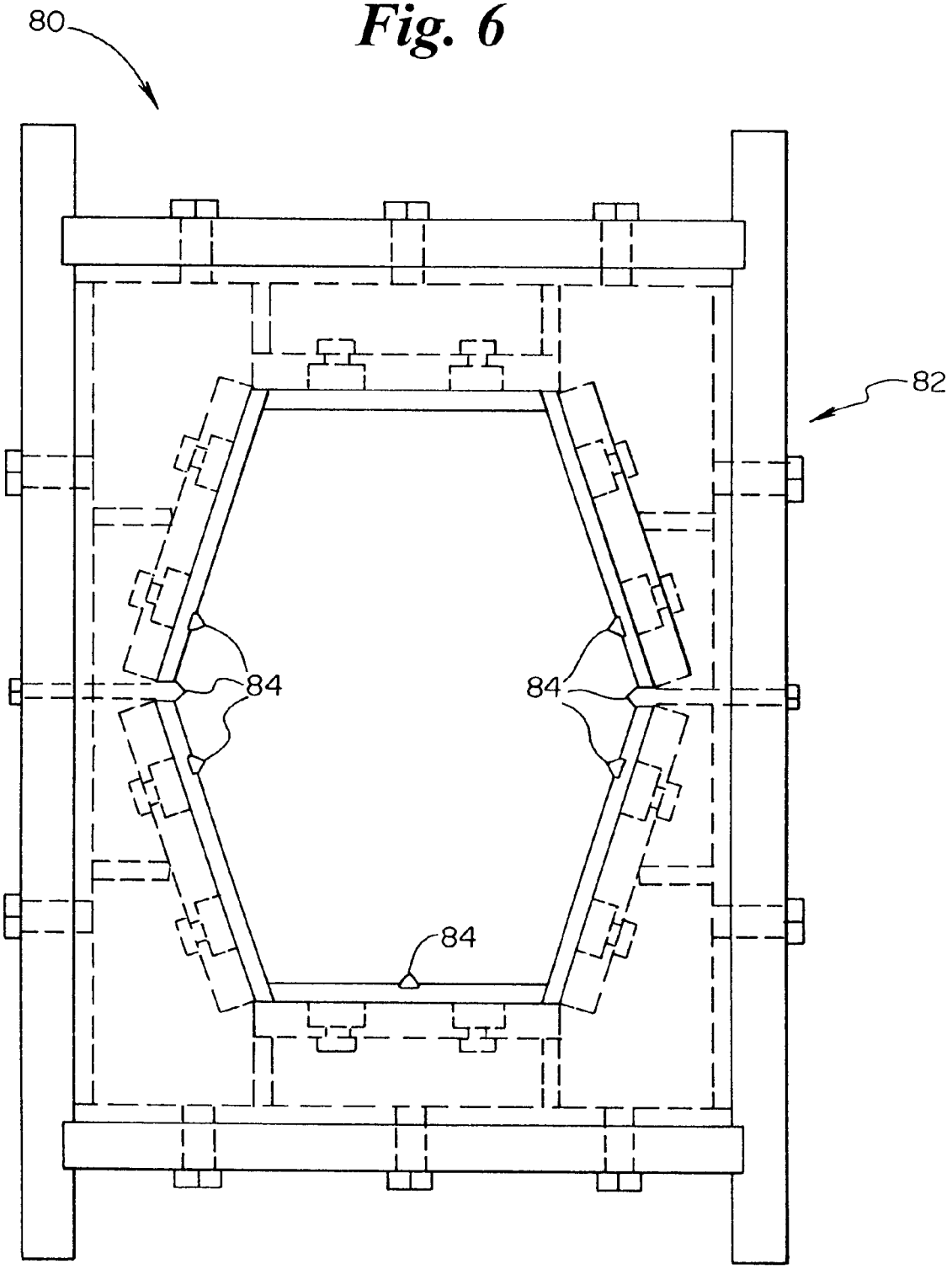
FIG. 6 is a top plan view of one embodiment of the retaining wall block mold in accordance with the present invention.

Referring to FIG. 6, a mold 80 is generally shown for forming block assembly 16. A double block 81 is formed by mold 80. Double block 81 includes two opposing recessed blocks 17, which are split into separate blocks. Mold 80 is used in connection with a retaining wall block molding machine (not shown). Mold 80 generally includes side and rear wall support structure 82, which form the desired mold design. Additionally, score members 84 extend from the mold support structure 82 for forming scores within the molded retaining wall double blocks 81 to aid in splitting double block 81 at a later time.

Figure 7:
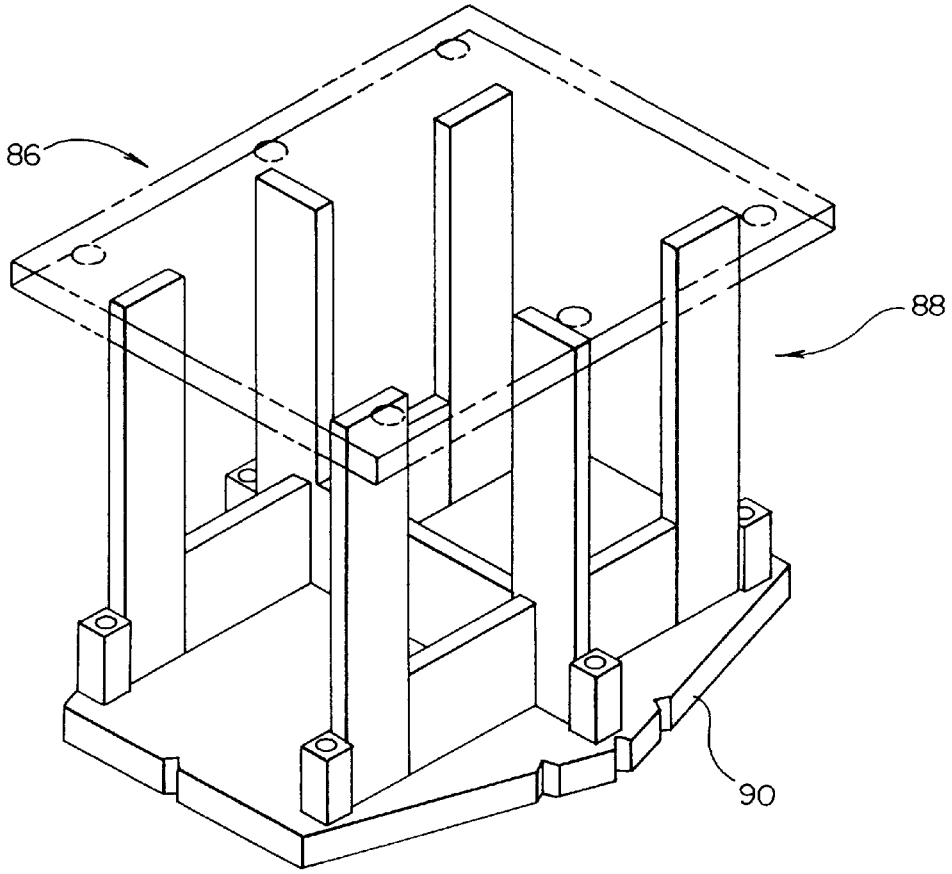
FIG. 7 is a perspective view of one embodiment of the stripper head assembly for forming the retaining wall recessed block in accordance with the present invention.

Referring to FIG. 7, a stripper head assembly 86 is generally shown. Stripper head assembly 86 includes stripper head frame 88 coupled to stripper shoe 90. Stripper head assembly 86 functions to compress the cement aggregate mix within mold assembly 80, to mold recessed block 17 to a desired shape, and to further push downward through mold assembly 80 to remove the retaining wall recessed blocks 17 from the mold assembly 80.

Figure 8:
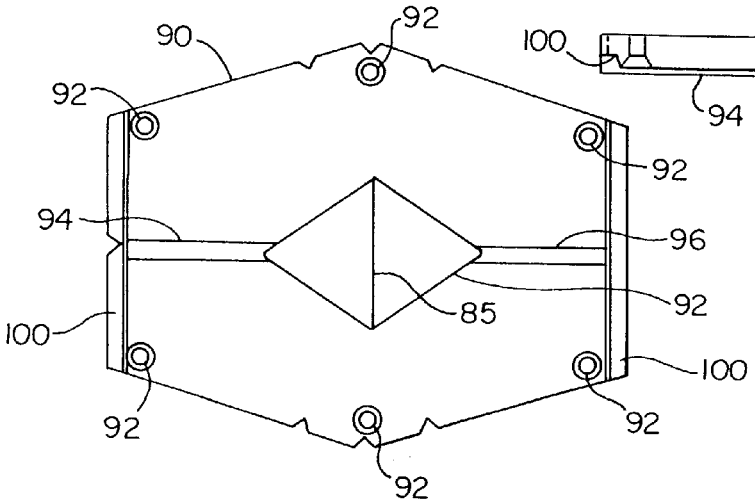
FIG. 8 is a top plan view of one embodiment of the stripper shoe assembly in accordance with the present invention.
Figure 9:
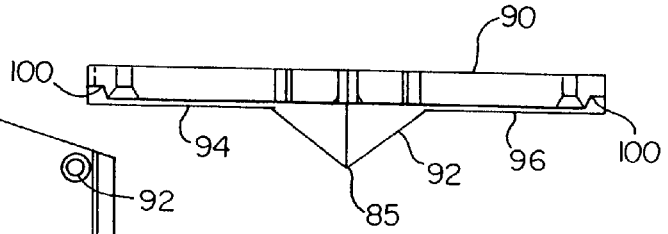
FIG. 9 is a side elevational view of the stripper shoe assembly of FIG. 8.

Referring to FIG. 8, a top view of stripper shoe 90 is shown. Stripper shoe 90 is sized to pass through mold assembly 80. Stripper shoe 90 is coupled to mold support structure 82 using bolts 92. Referring to FIG. 9, stripper shoe 90 further includes raised portion 92 located proximate the center of stripper shoe 90. Raised portion 92 includes a score 85. Extending from raised portion 92 to the edges of stripper shoe 90 are raised bar 94 and raised bar 96. The size and shape of raised portion 92 corresponds to the desired recessed area to be formed within double block 81 for each molded recessed block 17. Score 85 produces an indentation in double block 81 to aid in splitting double block 81. Raised bar 94 and raised bar 96 are used for forming channel 78 within each recessed block 17. Stripper shoe 90 further includes recess 98 and recess 100 for forming each lighted retaining wall block anchor system 74. The design of stripper shoe 90 allows recessed blocks 17 to be mass produced/manufactured as part of a retaining wall block molding process.

Figure 10:
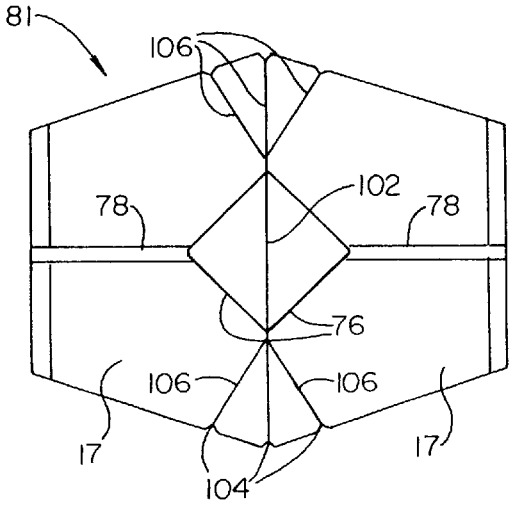
FIG. 10 is a top plan view of the double block formed using the stripper shoe assembly of FIG. 8.
Figure 11:
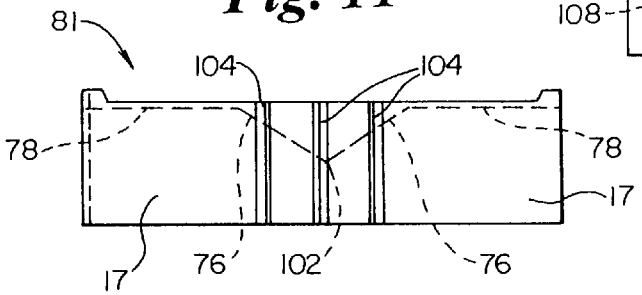
FIG. 11 is a side elevational view of the double block of FIG. 10.

Referring to FIG. 10, a double block 81 is shown. FIG. 11 shows a side elevation of double block 81. Double block 81 (including two recessed blocks 17) is formed by mold assembly 80 and stripper head assembly 86 as shown using a mold block machine (not shown). Mold assembly 80 is set within the mold block machine on a pallet (not shown). The desired amount of cement aggregate mix is fed into the mold assembly 80. The stripper head assembly 86 is lowered over the central area of the mold assembly 80, compressing the cement aggregate mix within the mold support structure 82.

As the aggregate mix is compressed within mold support structure 82, the aggregate mix fills mold support structure 82 to the desired shape of the retaining wall lighted blocks to form a double block 81. Additionally, the score members 84 produce score lines 104 along the sides of the lighted retaining wall blocks.

As stripper shoe 90 is compressed into mold assembly 80, raised portion 92 forms recessed area 76 within the recessed blocks 17, and raised bar 94 and raised bar 96 form the channel 78 within each recessed block 17. Additionally, score 85 leaves score indentation 102 in recessed area 76 to aid in splitting double block 81. After the stripper head assembly 86 compresses the aggregate mix within mold assembly 80 to form the desired shape of the recessed blocks 17 within double block 81, the stripper head assembly 86 further pushes through the mold assembly 80 to remove double block 81 from the mold assembly 80. As the stripper head assembly 86 is pushed through mold assembly 80, the pallet located below the mold assembly 80 drops down with the double block 81 located on the pallet.

Due to the basic contoured shapes of raised portion 92, raised bar 94, and raised bar 96, the double block 81 easily releases from stripper shoe 90. It is recognized that means for keeping stripper shoe 90 free from cement aggregate mix after forming double block 81 may be used, such as by raking, scrapping, spot heating, or chemical means to free cement aggregate mix from the stripper shoe 90.

The pallet supporting the recessed blocks 17 is transferred onto a rack. The double blocks 81 are now cured through means known to those of skill in the art. Known curing mechanisms include simple air curing, autoclaving, and steam curing or mist curing. In one preferred embodiment, the blocks are located within a steam room for steam curing. The blocks are cured by slowly increasing the temperature and steam within the steam curing room over time, until the desired temperature is reached. The room is maintained at the desired heat and steam temperature for a period of time. The heat and steam are then turned off as desired and the blocks are allowed to cool.

After cooling, the blocks are transferred by a conveyor system through a splitter system for splitting. The splitter system is then operated for splitting the blocks along the scored areas. Lines 106 indicate where the splitter knives contact double block 81 for splitting. Within the present invention, it is recognized that a conventional splitter system may be used. It is also recognized that the splitter system knife may be set to penetrate the block scored areas to the desired depth, such as the depth of recessed area 76.

Figure 12:
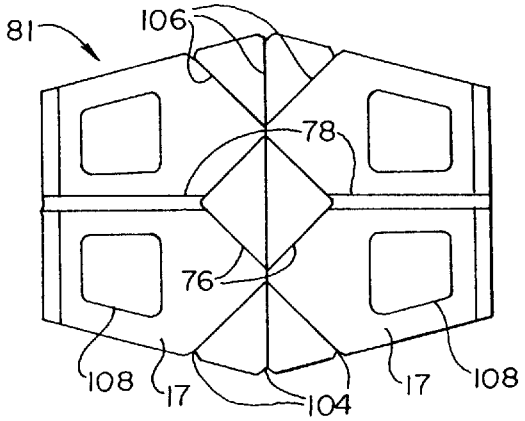
FIG. 12 is another embodiment of another double block formed in accordance with the present invention; and, FIG. 13 is a side elevational view of the double block of FIG. 12.
Figure 13:
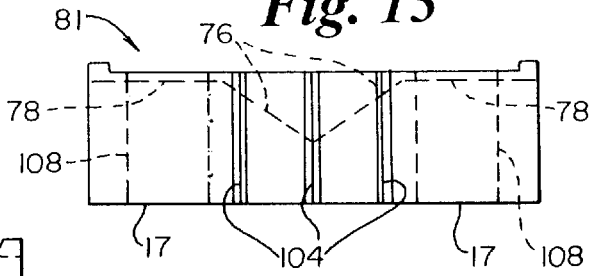

Referring to FIG. 12 and FIG. 13, it is also recognized that core members may be set within mold assembly 80 to produce recessed blocks 17 having cored areas 108.

The light fixture 18 may be field set within the recessed block 17. To assemble the retaining wall block assembly 16, a sealant or adhesive 56 is located within channel 54. Light fixture 18 is positioned within recessed area 76, securing housing 40 to recessed block 17. Light fixture power cord 36 is fed through power cord channel 78 to exit the rear surface of lighted retaining wall block 18. Block assembly 16 may now be set at the desired locations within the retaining wall system 10. Light fixture power cord 36 is coupled to landscape electrical power feeder 28 using quick disconnects 38.

After completion of the retaining wall system 10, lamp units may be inserted within housing 40, and the light fixture lens system 52 snap-fit over each housing flange 50. Lens system 52 may be further secured to housing 40 using screws. Since light fixture lens system 52 is easily removable from housing 40, light fixture 18 lamps are easily changed out without requiring the block assembly 16 to be removed from the retaining wall system 10.

The unique retaining wall system 10 of the present invention allows retaining walls to be used for lighting landscape, pathways, walkways, driveways, or other landscape fixtures without the need for conventional landscape light fixtures. The resulting lighted retaining wall system is also very aesthetically pleasing with a landscape design.

It will be understood that this disclosure is, in many respects, only illustrative. Changes may be made in details, particularly in matters of shape, size, material, and arrangement of parts, without exceeding the scope of the invention. For example, it is recognized that other molding methods may be used or other stripper shoe designs may be used for molding a desired recess within a retaining wall block for accepting a light fixture assembly. It is recognized that the light fixture assembly may be located within a recess at any location along the retaining wall block face or other surfaces thereof as desired. It is also recognized that other methods may be used for allowing the light fixture power cord to exit from the retaining wall block, such as through an adjacent retaining wall block within the retaining wall system. It is also recognized that the retaining wall block light fixture may take on various geometrical or non-conventional shapes and sizes while remaining within the scope of the present invention. Accordingly, the scope of the invention is as defined in the language of the appended claims.

What is claimed is:

1. A block assembly for use in retaining wall systems, comprising:

a block body having a front surface, a rear surface, a top surface, and a generally planar bottom surface;

said block body having a generally hemi-conical recess, formed in the bottom surface with respect to an axis parallel to the bottom surface, and opening into the front surface; and a light fixture assembly received within the recess, said light fixture having a housing conforming to said recess such that, when said light fixture is received within said recess, a base of said housing is substantially flush with the bottom surface.

2. The block assembly of claim 1 further comprising means for securing the light fixture assembly to the block body.

3. The block assembly of claim 1, wherein the light fixture assembly includes a power cord for connecting the light fixture assembly to a lighting power source.

4. The block assembly of claim 3, further comprising means for allowing the power cord to exit the block body, said allowing means comprising a channel formed in the bottom surface to receive the cower cord therein so that the power cord does not protrude from the channel below the bottom surface.

* * * * *